US006525515B1

(12) United States Patent
Ngo et al.

(10) Patent No.: US 6,525,515 B1
(45) Date of Patent: Feb. 25, 2003

(54) FEEDBACK APPARATUS AND METHOD FOR ADAPTIVELY CONTROLLING POWER SUPPLIED TO A HOT-PLUGGABLE SUBSYSTEM

(75) Inventors: Sang Ton Ngo, Cupertino, CA (US); James Hung Nguyen, San Jose, CA (US); David Chalmera Schie, Cupertino, CA (US); Ladislas G. Kerenyi, White Plains, NY (US); Khai Minh Le, Saratoga, CA (US)

(73) Assignee: Supertex, Inc., Sunnyvale, CA (US)

( * ) Notice: Subject to any disclaimer, the term of this patent is extended or adjusted under 35 U.S.C. 154(b) by 0 days.

(21) Appl. No.: 09/960,832

(22) Filed: Sep. 24, 2001

(51) Int. Cl.[7] ..... G05F 1/573
(52) U.S. Cl. ..... 323/277; 323/274; 323/275
(58) Field of Search ..... 323/273, 274, 323/275, 276, 277

(56) References Cited

U.S. PATENT DOCUMENTS 5,666,043 A * 9/1997 Henry et al. ..... 323/277
5,666,044 A * 9/1997 Tuozzolo ..... 323/277
6,184,669 B1 * 2/2001 Matsuo ..... 323/303
6,285,175 B1 * 9/2001 Massie ..... 323/290
6,335,654 B1 * 1/2002 Cole ..... 323/546

* cited by examiner

*Primary Examiner*—Bao Q. Vu
(74) *Attorney, Agent, or Firm*—Jeffrey D. Moy; Harry M. Weiss; Weiss, Moy & Harris, P.C.

(57) ABSTRACT

A feedback apparatus and method for adaptively controlling power supplied to a hot-pluggable subsystem controls the inrush current of the hot-pluggable subsystem upon application of power. The apparatus and method adaptively control a pass device by detecting the current through the pass device during initial charging of a load capacitance and scaling back the turn-on rate at the pass device control terminal input in conformity with the detected current and a predetermined rate set by a ramp generator. A ramp capacitor is coupled to the control terminal of the pass device through a diode to permit use of the capacitor for timing purposes as well as preventing transient turn-on of the pass device during initial application of power.

49 Claims, 6 Drawing Sheets

FEEDBACK APPARATUS AND METHOD FOR ADAPTIVELY CONTROLLING POWER SUPPLIED TO A HOT-PLUGGABLE SUBSYSTEM

BACKGROUND OF THE INVENTION

1. Field of the Invention

The present invention relates generally to power supplies, and more specifically to a feedback method and apparatus for adaptively controlling power supplied to a hot-pluggable subsystem.

2. Background of the Invention

Computers and other electronic systems such as telecom systems require replacement and/or addition of subsystems without removing power from a host system. Known as "hot-pluggable" subsystems, these electrical devices must operate properly after connection and disconnection, while not disrupting the operation of other electronic circuits. Telecom systems typically operate at a much higher voltage (−48V) and telecom subsystems typically have high current drains due to the low-impedance nature of telephony circuits. Thus, the input capacitances required to filter EMI and conducted ripple on the input of telecom subsystems are typically large and a hot-pluggable subsystem for telecom generally requires sophisticated inrush current protection.

Additionally, peripheral devices, storage devices and redundant processor modules in both network server systems and personal computing systems can be removed or attached while the systems remain active. Network connections between systems must also support active connection and disconnection, since the entire network should not be shut down to add or remove computers or other devices. Power to connected sub-systems may be supplied through network interface cables. For example, the Powered Ethernet Specification 802.3 promulgated by the Institute of Electrical and Electronic Engineers (IEEE), specifies an interface wherein power is supplied through the network cable connection. Hot-pluggable network hubs, network telecom cards including fiber optic interfaces, transceivers and cards for analog telephonic interfaces may all be powered by a host system.

Inrush current must be managed in hot-plugging systems, as the transients generated when the hot-pluggable subsystem is connected to the host system can damage connectors, cause dips in the power supply rails and generate electromagnetic interference (EMI) that affect the operation of the host system and other connected subsystems.

Power supplies for hot-pluggable subsystems having a minimum of electrical connections and incorporated within small integrated circuit packages are very desirable. In general it is useful to provide power supply integrated circuits requiring a minimum of circuit area and external connections.

Power supplies for a hot-pluggable subsystem are typically required to provide a stable time period in which the power supply voltage applied to the hot-pluggable device does not vary while the hot-pluggable device initializes. This presents difficulty in that mechanical contact bounce may electrically connect and disconnect the power supply conductors several times before the device is properly coupled. A de-bounce time interval and/or a power-on-reset (POR) time interval are typically provided to prevent improperly initializing a hot-pluggable subsystem, but implementation of the de-bounce and power-on-reset time intervals typically requires additional components, adding to size, complexity and cost of power supply electronics.

Other features desirable in a power supply for coupling to a hot-pluggable sub-system are short-circuit protection (or current limiting) to prevent misalignment or accidental shorting of the power supply pins from damaging the power supply or hot-pluggable subsystem. Short-circuit protection differs from inrush current protection in that short-circuit protection must distinguish from a transient short-circuit type load (virtual AC short circuit) that is produced by the large input capacitors of hot-pluggable subsystem power supplies or bypass capacitors. The pass device used in a hot-pluggable power supply can fail or be degraded in operating characteristics and reliability if a short circuit is placed across the output terminals of a hot-pluggable power supply.

Typically, implementation of short-circuit discrimination vs. current limiting requires additional complexity within the power supply control circuits and additional components to set operating levels, etc. Large capacitors are required to prevent startup transients from turning on the pass device through the parasitic capacitances of the pass device. Short-circuit protection circuits as well as current limiting circuits are generally desirable with an auto-restart feature so that input power does not have to be removed in order for the hot-pluggable power supply to recover from the protection conditions. Auto-restart circuits typically require external timing components, and due to the long time constants required, these restart circuits use large capacitors.

Under-voltage lockout (UVLO) protection is also desirable in hot-pluggable systems, so that the hot-pluggable sub-system power supply does not produce an output until the power supply input has reached a minimum voltage level. Over-voltage protection (OVP) is also desirable, to prevent damage to the hot-pluggable subsystems power converters and other components.

Therefore, it would be desirable to provide an improved method and system for controlling the current supplied to a hot-pluggable subsystem. It would be further desirable to control power supply current during initialization and mechanical contact bounces while minimizing additional timing components, external connections and external components to support operational features.

It would additionally be desirable to incorporate UVLO protection, OVP and short-circuit protection without requiring additional external connections. It would further be desirable to provide the above-mentioned features within a small integrated circuit package having a minimum of electrical connections.

SUMMARY OF THE INVENTION

The above objective of adaptively controlling power supplied to a hot-pluggable subsystem is achieved in a feedback method and apparatus. The apparatus includes a pass device for controlling a power supply output and a control circuit coupled to a control terminal of the pass device. The control circuit controls a rate of rise of a control signal at the control terminal of the pass device during turn-on of the pass device in conformity with a detected current through the pass transistor. A capacitor used to prevent transient turn-on of the pass device may be subsequently used for timing purposes by isolating the capacitor with an isolation circuit. Sequencing of timed events may be programmed by multiple impedances connected external to an integrated circuit embodying the apparatus to set multiple time constants for the timing function.

The foregoing and other objectives, features, and advantages of the invention will be apparent from the following, more particular, description of the preferred embodiment of the invention, as illustrated in the accompanying drawings.

DETAILED DESCRIPTION OF THE PREFERRED EMBODIMENTS

Figure 1:
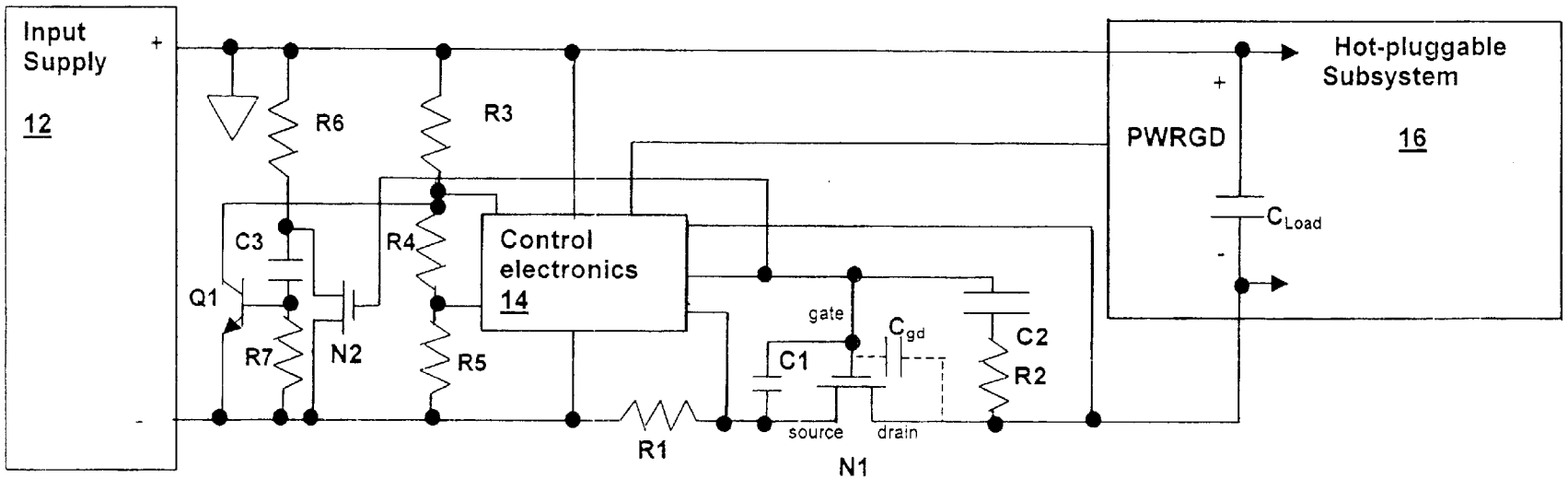
Fig. 1 (Prior Art)
FIG. 1 is a schematic diagram depicting a prior art power supply for a hot-pluggable subsystem.

Referring to FIG. 1, a prior-art power supply for a hot-pluggable subsystem is depicted. An input supply 12, provides a source of power for operation of internal components of the power supply and for supplying power to a hot-pluggable subsystem 16. A pass device N1, controls current supplied to $C_{Load}$ and thus the power supplied to hot-pluggable subsystem 16. A control electronics 14 controls the gate of pass device N1, so that startup characteristics can be managed. A feedback connection from the drain terminal of pass device N1 that is coupled to hot-pluggable subsystem 16 is provided to permit control of pass device N1. A feedback network using capacitor C2 is typically provided to control inrush current, as the charging of $C_{Load}$ will be proportional to the current supplied by control electronics 14 to discharge capacitor C2. Capacitor C1 is required to prevent the momentary connection of hot-pluggable sub-system 16 from turning on pass device N1 via a capacitive voltage divider comprising capacitances $C_{gs}$, $C_{gd}$ and $C_{Load}$. Capacitor C2 is effectively in parallel with $C_{gd}$, enhancing the divider effect, thus causing pass device to conduct more current. Therefore, C1 must be of sufficient size to keep the effective $C_{gs}$ large enough to prevent transient turn-on. Resistor R2 is also added to reduce spurious turn-on of pass device N1 caused by the parasitic capacitive divider, by providing a fixed-frequency impedance in series with capacitor C2.

Since capacitances $C_{gs}$ and $C_{gd}$ are relatively small parasitic capacitances associated with pass device N1 and capacitance $C_{Load}$ is typically very large (generally the input capacitor of a power converter), without the presence of capacitor C1, the voltage at the gate of pass device N1 would initially rise rapidly, causing current to flow through pass device N1 before the control circuitry has initialized and can drive the gate of pass device N1 to ground.

Although it is mentioned above that $C_{gd}$ and $C_{gs}$ are relatively small, the total gate capacitance of some power metal oxide semiconductor field effect transistors (MOSFETs) is on the order of 1000 picofarads. In order for the power supply of FIG. 1 to operate properly, capacitor C1 must be made quite large (on the order of 0.1 microfarad for larger pass devices) to prevent conduction of pass device N1 during the startup transient. Also, capacitor C2 which may have a value on the order of nanofarads, must withstand the voltage difference between the output of the hot-swap power supply (typically −48V) and ground.

A power-good (PWRGD) signal is supplied from control electronics 14 to hot-pluggable subsystem 16 to indicate that the voltage at the drain of pass device N1 has risen to the point that circuits within hot-pluggable subsystem 16 can operate. Typically this will be a DC-DC converter within hot-pluggable subsystem 16. But, since the PWRGD signal is derived from a comparator within control electronics 14, when the output voltage threshold is crossed, depending on the load incurred when PWRGD enables the loads within hot-pluggable subsystem 16, the additional current required to supply the loads and continue charging $C_{Load}$ will cause the short circuit protection to be activated, causing improper operation.

Undervoltage and overvoltage protection are provided in the prior art circuit of FIG. 1 by a resistor ladder formed by a resistor R3, a resistor R4 and a resistor R5. The junction of resistor R3 and resistor R4 is coupled to an undervoltage control input of control electronics 14. The junction of resistor R4 and resistor R5 is coupled to an overvoltage protection input. A window comparator (with hysteresis to eliminate ringing around the trigger point) or other suitable circuit can be used to determine whether or not an overvoltage or undervoltage condition exists by comparing the undervoltage and overvoltage inputs to a reference voltage within control electronics 14.

Short-circuit protection and current limiting of input supply 12 and pass device N1 is provided by control electronics 14. Short-circuit protection typically is provided by a current sense resistor R1 which provides a voltage to control electronics 14 that is proportional to the current passing through pass element N1. If the load is shorted during turn-on of pass device N1, the voltage across sense resistor R1 rises quickly causing control electronics 14 to quickly turn off pass element N1 before pass element N1 can be damaged. Control electronics 14 must distinguish between normal in-rush current cause by a large load capacitance and a startup short-circuit current condition in order to prevent the hot-swap connection from activating the short-circuit protection within control electronics 14.

Auto-restart circuitry is implemented in the prior art circuit of FIG. 1 by a one-shot circuit comprising resistors R6 and R7, a capacitor C3, a transistor Q1 and a transistor N2. When a short-circuit or over-limit current condition is detected via sense resistor R1, the gate of pass device N1 is pulled low, turning off transistor N2. Once transistor N2 is turned off, capacitor C3 charges exponentially through resistor R6 and resistor R7. The displacement current through capacitor C3 causes a voltage drop across resistor R7, turning on transistor Q1. Therefore, while capacitor C3 is charging, the under-voltage input of control electronics 14 is pulled low, effectively holding control electronics 14 in a reset condition. When capacitor C3 is charged almost completely, the current through resistor R7 falls below the threshold $V_{be}$ of transistor Q1 and the under-voltage input rises to its nominal value.

Since the output of input supply 12 is still within proper range for operation of the prior art hot swap power supply, the control electronics will restart operation. When operation is restarted, pass device N1 will turn on until the voltage across sense resistor R1 again exceeds a threshold, provided a short-circuit condition remains.

It should be noted for the embodiments of the present invention as depicted in the following figures, that the pass device and control electronics may be incorporated within a host system or a hot pluggable system or both. For example, in a Powered Ethernet environment, it is useful to provide a hot-pluggable power control device within the host system to provide short-circuit protection and other features such as contact de-bounce and inrush current control, while also providing a second power control device within the hot-pluggable subsystem itself. This second power control device is used to "hold off" current drain or any load impedance for a time period during startup, since the Powered Ethernet specification requires "discovery" of a specific impedance signature before turn on and before a hot swapping function may occur. Typically these functions are provided by circuits designed to perform the particular tasks required on each side of the hot-pluggable subsystem connector, but as will be illustrated for the embodiments of the present invention, an integrated circuit performing functions required on each side of the connector can be an identical device, wherein differing portions of the full functionality of the device are utilized on the different sides of the connector.

While the illustrative embodiments depicted in the drawings and the accompanying description are directed toward negative voltage power supplies having an N-channel pass devices in the power path, a person of ordinary skill in the art will understand that the techniques and apparatus described herein can be adapted to other types of power supply without undue experimentation. For example, the techniques of the present invention may be adapted to a positive voltage power supply, a power supply having a pass device in the return path, or a power supply having a P-channel pass device by re-arranging the polarity of operation of the control electronics and types of pass element.

Figure 2:
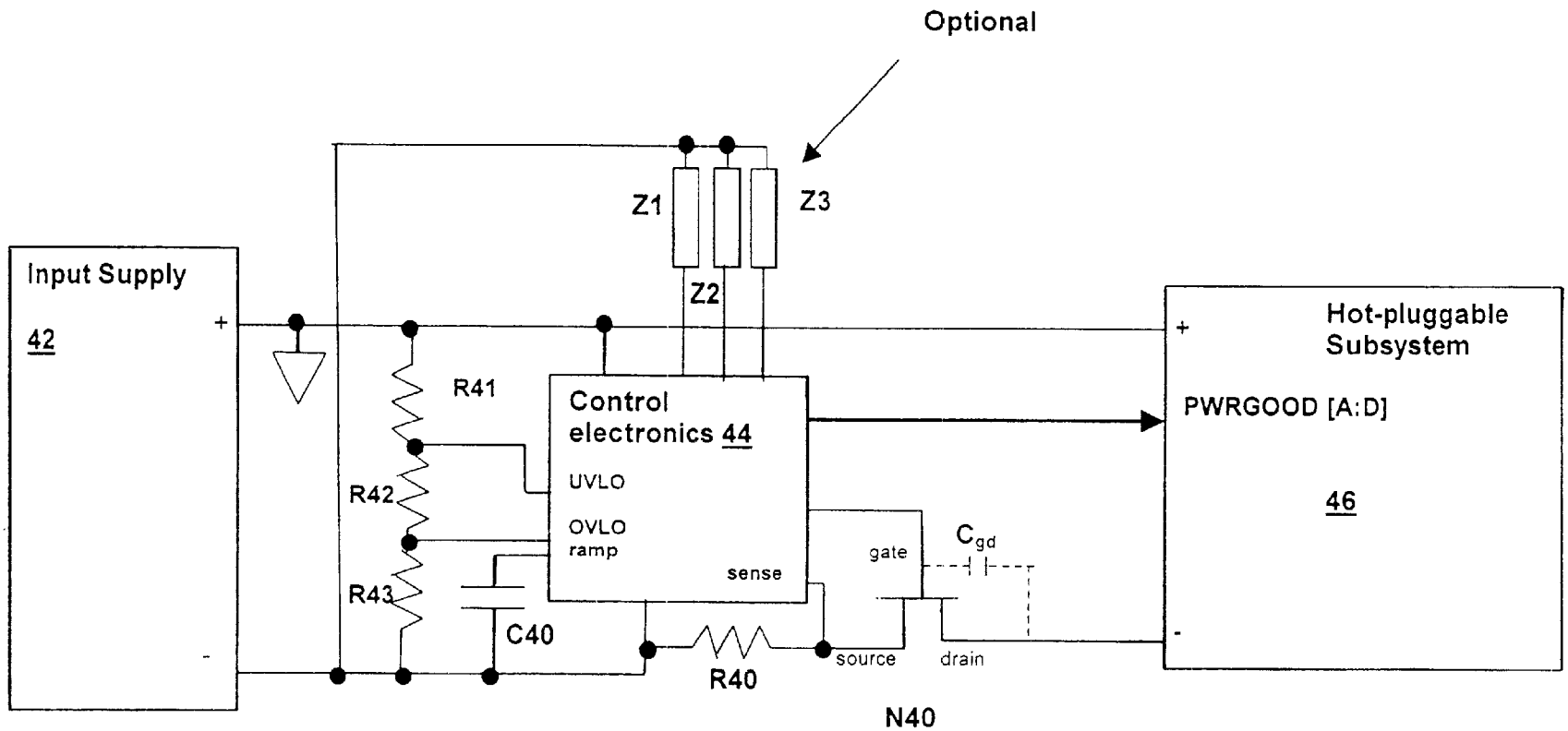
FIG. 2 is a schematic diagram depicting a power supply for a hot-pluggable subsystem in accordance with a preferred embodiment of the invention.

Referring now to FIG. 2, a power supply for a hot-pluggable subsystem in accordance with a preferred embodiment of the invention is depicted. An input supply 42, provides a source of power for operation of internal components of the power supply and for supplying power to a hot-pluggable subsystem 46. Internal regulators derive their power source from input supply 46 to provide voltages internal circuits. A pass device N40, controls power supplied to hot-pluggable subsystem 46. Pass device N40 may be a MOSFET, IGBT or other suitable control device, including bipolar transistors. When a bipolar transistor is used as a pass device, it should be understood by on of ordinary skill in the art that references to controlling gate voltage may equally apply to controlling the base current of a bipolar transistor, and circuit adjustments or modifications in conformity with the requirements of bipolar transistors may be made. A control electronics 44 controls the gate of pass device N40, so that startup characteristics can be managed. Control electronics 44 may supply one or more PWRGOOD outputs to hot-pluggable subsystem 46 for sequencing of power supplies and logic within hot-pluggable subsystem 46. Optional impedances Z1–Z3 are provided for external programming of the time periods between assertion of multiple power good signals.

The junction of resistor R41 and resistor R42 is coupled to an undervoltage control input of control electronics 44. The junction of resistor R42 and resistor R43 is coupled to an overvoltage protection input. A window comparator or other suitable circuit can be used to determine whether or not an overvoltage or undervoltage condition exists by comparing the undervoltage and overvoltage inputs to a reference voltage within control electronics 44.

A capacitor C40 is coupled to control electronics 44 and sets the rate at which the gate of pass device N10 is charged. Capacitor C40 is coupled through control electronics 44 to the gate of pass device N40 during initial turn-on to prevent N40 from turning on due to the capacitive voltage divider effect described above for the prior art and the first preferred embodiment of the invention. Capacitor C40 is also used for other purposes such as restart timing by novel techniques embodied within control electronics 44. Note that a feedback connection from the drain terminal of pass device that is coupled to hot-pluggable subsystem 46 is not required to control pass device N40 during startup, in contrast to prior art circuits.

Since the completion of the startup sequence is not determined by a drain terminal voltage sense, but by the feedback loop, the prior art problem illustrated in the description of FIG. 1 wherein the power good indication triggers a short-circuit condition will not occur, as the charging of the load capacitance will be complete when power good indications are asserted.

Pass device N40 is controlled via a current feedback mechanism within control electronics 44 by using a sense resistor R40 to provide a measure of current during startup of the hot-swap power supply. Initially, before pass device N40 begins to conduct, a voltage ramp is produced within control electronics 44 and is coupled to gate terminal of pass device N40. The rate of rise of the ramp voltage sets the start-up time of the hot-swap power supply, and an offset between the voltage ramp and the gate terminal of the pass device provides a power-on-reset time by activating the gate terminal only after the voltage ramp has risen past a predetermined level.

The undervoltage lockout holds the ramp generator in a reset condition and in combination with the above-described ramp voltage offset, eliminates the effect of contact bounce that may occur upon connection of the hot-pluggable power supply to input supply 42. Multiple mechanical bounces will produce no output at hot-pluggable subsystem 46, as the ramp voltage offset provides a delay that is longer than the longest contact on period anticipated and loss of contact will cause the undervoltage lockout circuit to reset the ramp generator.

After pass device N40 begins to conduct (after the ramp at the gate of pass device N40 reaches the threshold voltage of pass device N40), a exponential response is achieved via a feedback mechanism. The exponential rise of the gate voltage of pass device N40 after the threshold voltage is reached slows the rate-of-rise of the drain current of pass device N40, providing soft start operation. Independence of the characteristics of pass device N40 is achieved through the use of the feedback mechanism since higher drain currents of pass device N40 will slow the rate of rise of the gate voltage of pass device N40.

Control electronics 44, pass device N40, and any other associated components forming a hot-pluggable power supply can be incorporated in a host system, a hot-pluggable subsystem or both. As illustrated in the above-disclosed example for powered ethernet, a hot-pluggable power supply can be incorporated in a host system to perform some functions and within a hot-pluggable subsystem to perform other functions.

Figure 3:
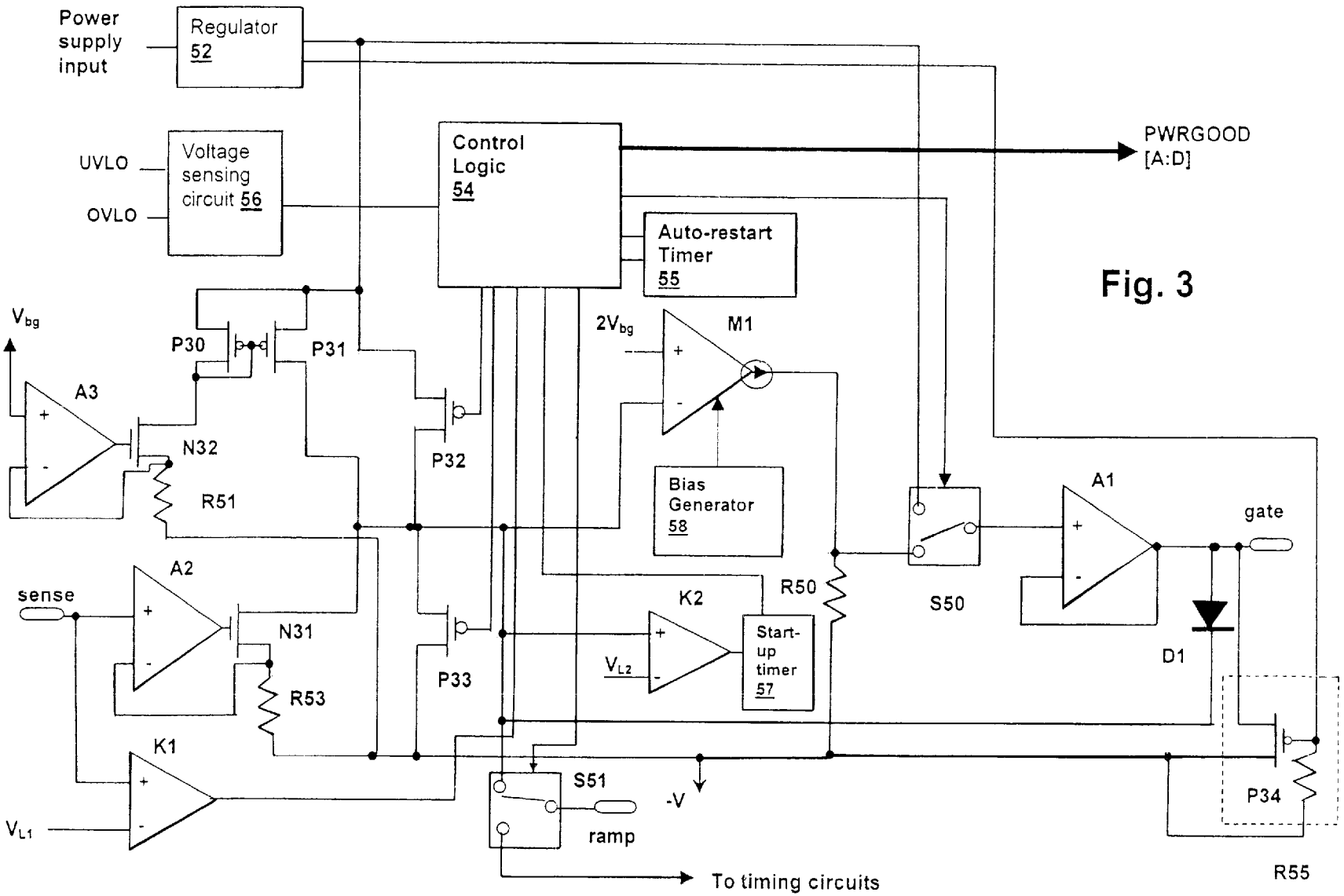
FIG. 3 is a schematic diagram depicting details of the control electronics of FIG. 2.

Referring now to FIG. 3, details of the control electronics 44 of FIG. 2 are depicted. A regulator 52 provides internal regulated power for the control electronics. A voltage-controlled current source comprising amplifier A3, transistor N32 and resistor R51 provides a reference current derived from a bandgap reference $V_{bg}$. A current mirror comprising transistors P30 and P31 mirrors the output current from the voltage controlled current source (the current through transistor N32) and is used to derive a current from the positive rail output of regulator 52. This dual-mirrored circuit improves the accuracy of the circuit, since the bandgap reference output $V_{bg}$ is relative to the negative supply input −V and a current source relative to the positive output of regulator 52 provides a reference to the proper (positive) rail. A voltage-controlled current sink comprising amplifier A2, transistor N31 and resistor R53 removes current from a ramp node that is coupled to the current mirror output and voltage controlled current sink output through a switch S51. External capacitor C40 of FIG. 2 is coupled to the ramp terminal and the charging of capacitor C40 is thereby controlled by the current mirror output and voltage-controlled current sink output. Resistor R53 is matched to resistor R51, so that temperature and process variations within the integrated circuit will affect the current mirror/voltage controller current source output and the voltage-controlled current sink output equally, canceling any potential thermal error and errors due to semiconductor process variation in the components comprising the feedback loop. The matching of component characteristics is achieved by "drawing" them in a interdigitated "sea of resistors/capacitors" implementation on the integrated circuit die. The input of the voltage-controlled current sink is coupled to a sense terminal that is coupled to external sense resistor R40.

Until the current through R40 has reached a level that produces a current from the voltage-controlled current sink that is equal to the reference current provided by the current mirror, the voltage at the ramp terminal will increase as the current sourced by the ramp terminal charges external capacitor C40, which is coupled to the ramp terminal.

The current through sense resistor R40 is controlled by pass device N40. The gate of pass device N40 is coupled to the gate terminal, which is coupled to buffer A1. The voltage at the input to buffer A1 is initially provided by a resistor R50 that converts a current provided by transconductor M1, which is coupled to buffer A1 through a switch S50. Switch S50 is set at startup by control logic 54 to couple the output of transconductor M1 to the input of buffer A1. In this configuration, the transconductor is controlled by a feedback loop formed by sense resistor R40 and voltage-controlled current sink comprising amplifier A2, transistor N31 and resistor R53, causing the rate of change of the voltage at the ramp terminal to follow a exponential response, once transconductor M1 begins to conduct. It should be noted that responses other than exponential may be achieved in accordance with embodiment of the present invention. For example, the detected drain current (which provides the feedback signal) may be used to control the slope of the ramp in a manner that maintains piecewise linearity such as ramp slope adjustment by detecting a threshold current level. Or, the ramp may be stopped from increasing in response to the drain current reaching a predetermined level.

The power-on-reset interval that prevents turning on pass device N40 prior to a power-on-reset time period is provided by setting the bias point of transconductor M1 to twice the bandgap reference voltage $V_{bg}$, causing a linear rise in the voltage at the ramp terminal for voltages less than $2V_{bg}$, and the pass device is not conducting for this range, since transconductor M1 is not sourcing current through resistor R50. The bias set point of transconductor M1 thereby generates the ramp voltage/gate voltage offset described above that provides the power-on-reset timing. Therefore, a power-on-reset time is produced by the linear charging region of the ramp voltage below $2V_{bg}$ and the power-on-reset time interval is proportional to the capacitance of capacitor C40.

During the power-on-reset time interval, the capacitive voltage divider effect is averted by coupling the gate terminal to the external ramp capacitor C40 through diode D1. Thus, in the preferred embodiment, the external ramp capacitor performs the function provided in the prior art by capacitor C1 of FIG. 1, by clamping the gate of pass device N40 to ground. Since the gate voltage drive circuit of the present invention does not need to operate near the power supply rail, capacitor C40 can be used for other timing purposes such as circuit breaker timeout by driving its level above the gate voltage of pass device N40 and diode D1 will prevent the gate of pass device N40 from being changed by subsequent timing use of capacitor C40. Capacitor C40 can also be a low voltage type capacitor, since it is not coupled to the drain of the pass device. Capacitor C40 may be used between ground and an intermediate voltage during the initial hold-off time, as the gate of pass device N40 will be held off at this time.

As an alternative to using capacitor C40 to prevent transient turn-on of pass device N40, a depletion-mode transistor P34 may be used to couple the gate terminal to the negative power supply rail, transistor P34 having a gate coupled to a second output of regulator 52, so that depletion mode transistor is turned off subsequent to the startup transient, which occurs before the second output of regulator 52 has reached the threshold voltage of transistor P34. The second output of regulator 52 is used to provide a voltage higher than the highest voltage available at the gate terminal. The second output voltage must be greater than the gate terminal voltage by at least a threshold voltage of transistor P34, so that transistor P34 will not conduct after initial startup. A resistor R55 ensures that the gate of transistor P34 will be held at the negative rail potential until regulator R52 begins operating.

After the voltage at the ramp terminal reaches $2V_{bg}$ the gate of pass device N40 begins to charge due to current flow from transconductor M1 and the voltage at the ramp terminal continues to rise linearly until the threshold voltage of pass device N40 is reached at the gate terminal. Once the gate voltage reaches the threshold voltage, pass device N40 begins to conduct and feedback provided by sense resistor R40 and voltage-controlled current sink comprising amplifier A2, transistor N31 and resistor R53 slows the rate of increase of the ramp voltage to provide the exponential soft-start response mentioned above. Once the voltage at the gate terminal approaches the output voltage of regulator 52, switch S50 can be controlled to couple the input of buffer A1 to the output of regulator 52. Because resistors, particularly those implemented in semiconductor processes have resistances that vary greatly in response to temperature and process, resistor R50 and the internal resistor in transconductor M1 are matched by fabricating them in an interdigitated "sea of resistors", so that the variations are cancelled. Bias generator 58 has been included to compensate for variations in the magnitude of current source within transconductor M1, so that the voltage produced at the gate terminal is process independent.

After switch S50 couples the input of buffer A1 to regulator 52 output, the capacitor coupled to the ramp terminal may be reused by decoupling the ramp terminal from the feedback control circuits and coupling the ramp terminal to timing circuits by changing the state of switch S51. The control input of switch S51 is supplied by control logic 54 and may be the same signal that controls switch S50.

Short-circuit startup protection is provided by a comparator K2 that compares the voltage at the ramp terminal to a threshold voltage $V_{L2}$. If the threshold is not exceeded by the expiration time of a startup timer 57, control logic 54 resets all circuits and holds off restarting until an auto-restart timer 55 time period has elapsed. Auto-restart timer 55 may be a one-shot R-C timer, or may contain an oscillator circuit driving a counter, in order to provide a longer time constant using small capacitance values. Startup timer 57 may also be constructed in an oscillator/counter configuration to provide long timer periods using small RC values. Auto-restart timer 55 may reuse switch S51 and/or timing capacitor C40. (Startup timer 57 will not, as startup timer 57 is timing while capacitor C40 and switch S51 are used to generate the ramp and couple it to pass device N40).

Circuit breaker short-circuit protection is provided by a comparator K1 that compares the voltage at the sense terminal to a short-circuit maximum threshold voltage $V_{L1}$. If the short-circuit maximum threshold is exceeded, control logic 54 is signaled to turn off the gate of pass device N10, reset all circuits and initiate an auto-restart sequence.

All of the above faults should be detected to be persistent before generating a fault output (such as dropping pwrgood), a circuit using a logical AND gate having a delayed second input will generate a suitable delay.

Figure 4:
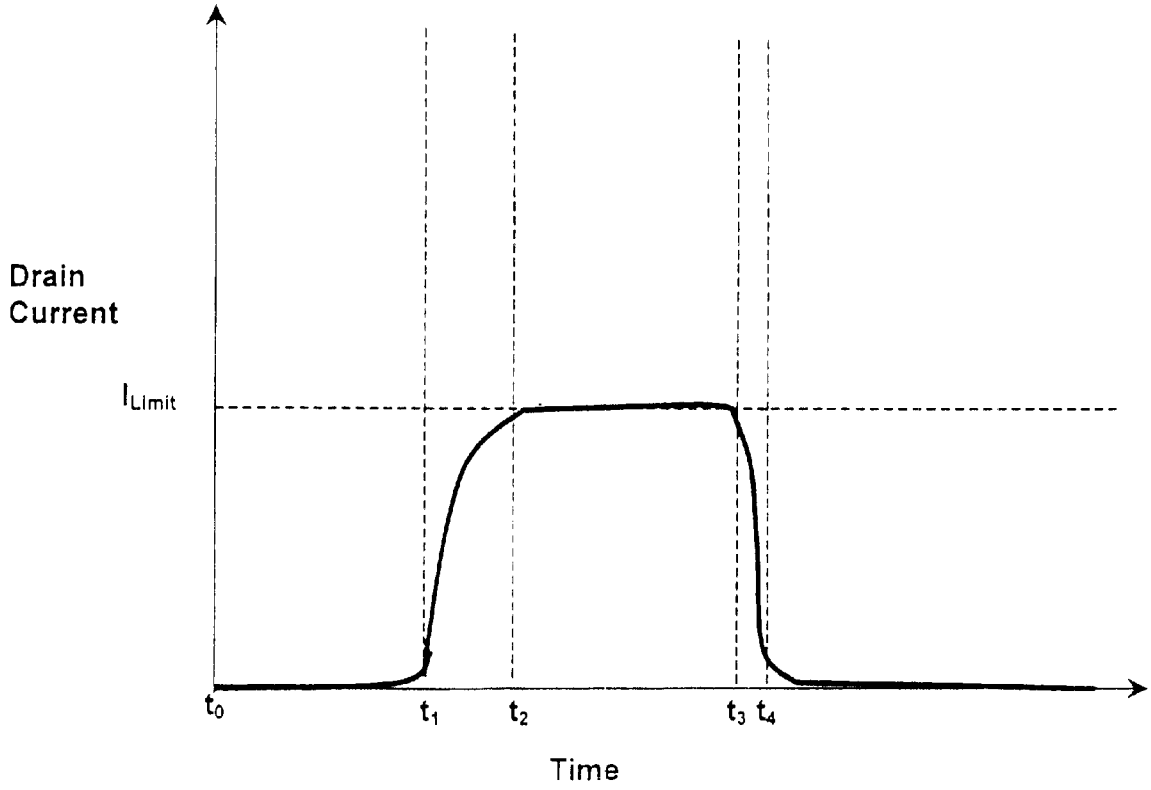
FIG. 4 is a pictorial diagram depicting a gate voltage of the pass device during operation of the power supply of FIG. 2.

Referring now to FIG. 4, the novel operation of the present invention is depicted by showing a unique drain current characteristic associated with the operation of the circuits of FIG. 2 and FIG. 3. From time $t_0$ until time $t_1$, no current flows through pass device N40 since the gate voltage ramp has not reached the threshold voltage. The initial time delay from $t_0$ until time $t_1$ is variable, as the internal ramp voltage will be reset for undervoltage lockout conditions. The undervoltage lockout condition and power-on reset will operate together during contact bounce when the hot-pluggable subsystem is inserted to hold off the output to the hot-pluggable subsystem until the voltages are stable for a sufficient time period. If there are no bounces, time $t_1$ will not vary. From time $t_1$ until time $t_2$, the drain current of pass device N40 is controlled by the ramp voltage as modified by the feedback from current sense resistor R40 and is exponential in shape, providing soft-start operation. At time $t_2$, the internal current limit $I_{Limit}$ is reached, and control electronics 44 holds the gate voltage of pass device N40 nearly constant until the load capacitance is fully charged. At time $t_3$, the load capacitance has charged to the point where the drain current of pass device N40 falls below the current limit value and at time $t_4$, the load capacitance is fully charged. If a startup short circuit condition exists the current will remain at the $I_{Limit}$ level. In this case comparator K2 will not activate (since the voltage at the ramp terminal will not rise to its normal value), and the expiration of startup timer 57 will cause a restart or shutdown condition, depending on whether auto-restart capabilities are selected or used in a particular implementation. While the depiction of FIG. 4 shows operation with a capacitive load, if there is a resistive component to the impedance present at the output of the hot-swap power supply prior to time $t_4$, the drain current will fall to the steady-state value of drain current to supply the resistive load, rather than zero.

Figure 5:
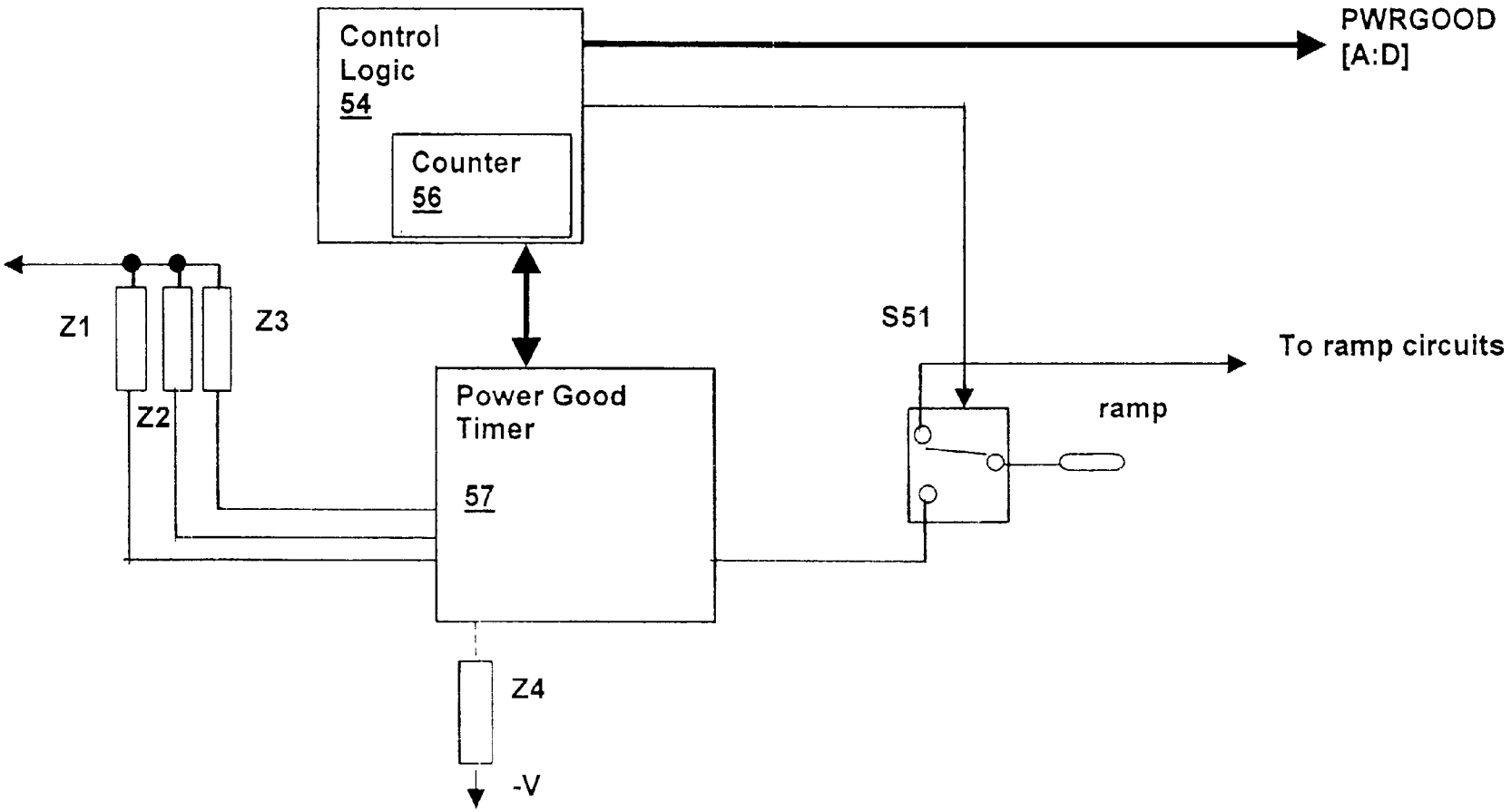
FIG. 5 is a schematic diagram depicting timing circuits within the control electronics of FIG. 2.

Referring now to FIG. 5, timing circuits in accordance with an embodiment of the invention are depicted. A power good timer 57 is coupled to external impedances Z1–Z3 for programming multiple time constants within control electronics 44 of FIG. 2. Power good timer 57 is coupled to the ramp terminal (and thus to external capacitor C40 of FIG. 2) by switch S51 and therefore the impedances will be resistors in this example when the ramp terminal capacitor is used to generate the timing for multiple power good signals.

Optionally, impedance Z4 may be used, either internally or externally connected as an alternative timing component. For example, if impedances Z1–Z3 are capacitors, to provide an RC timing circuit, the capacitor coupled to the ramp terminal would not be used and impedance Z4 would be a resistance. Power good timer 57 selects each of impedances Z1–Z3 in turn, providing multiple frequency inputs to a counter 56 or multiple counters within control logic 54. Counter 56 provides a longer timing interval that is attainable for a given capacitor size with a one-shot timer. Timing frequencies for enabling each of multiple power good signals PWRGOOD [A:D] are produced, with the time period between the multiple power good signals set by external impedances Z1–Z3 and the count value of counter 56. An internal discharge circuit may be used to discharge capacitor C40 (or a capacitive Z4) after each timing interval has expired.

Alternatively, the RC circuits may be set to ramp the entire time period, and counters will therefore not be needed. Other functions besides power sequencing may be produced by the timing circuits and the illustrative embodiment of FIG. 5 is provided to illustrate one such function and should not be considered limiting.

Figure 6:
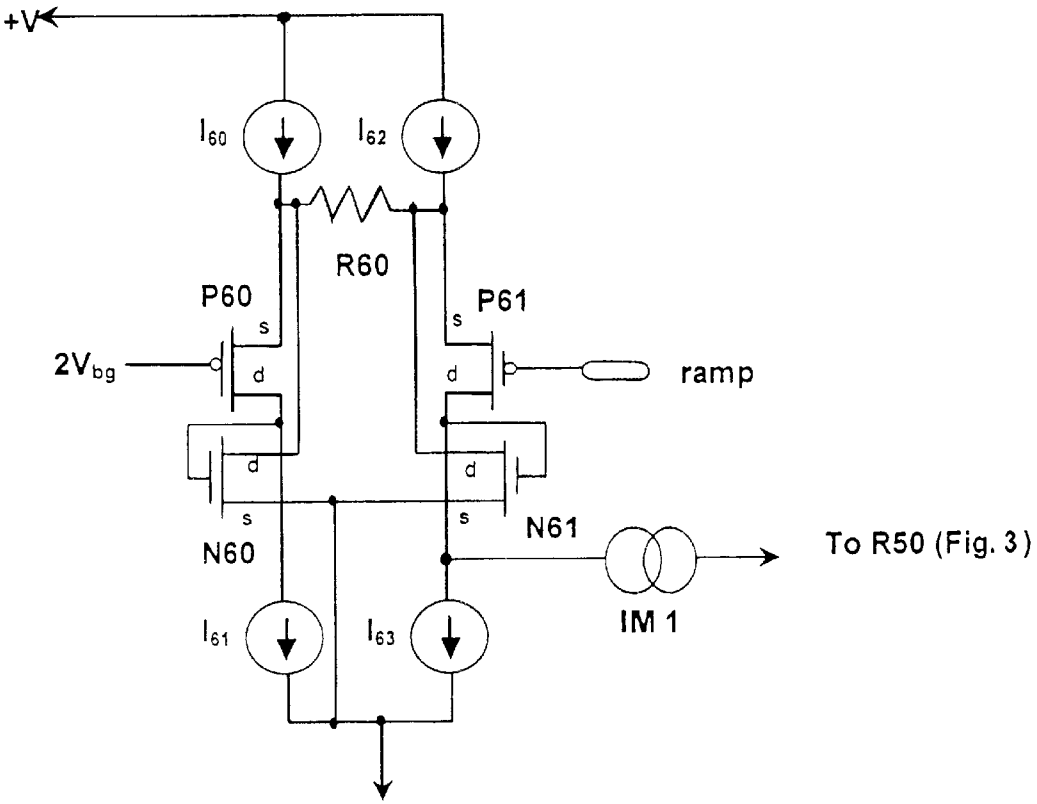
FIG. 6 is a schematic diagram depicting details of transconductor M1 of FIG. 3.

Referring now to FIG. 6, details of transconductor M1 of FIG. 3 are depicted. Transconductor M1 is formed by transistors N60, N61, P60, P61 and current sources $I_{60}$, $I_{61}$, $I_{62}$, and $I_{63}$. N-channel FETs N60 and N61 are matched, as are P-channel FETS P60 and P61. Current sources $I_{60}$ and $I_{62}$ are of equal magnitudes, as are currents $I_{61}$ and $I_{63}$. Current mirror IM1 couples the output of the transconductor to provide a buffered signal to resistor R50 of FIG. 3.

The above conditions provide a transconductor that will produce a current through resistor R50 of FIG. 3 proportional to the voltage of the ramp generator implemented at the ramp terminal, once the ramp terminal voltage has reached $2V_{bg}$. Other circuits, such as operational transconductance amplifiers or voltage-current converters may be used to produce a similar result as produced by the transconductor used in the preferred embodiment of the present invention.

The drain of transistor P61 is coupled to the gate of transistor N61, which forces a current through resistor R50, thus controlling the gate terminal during startup. The gate of transistor P61 is coupled to the ramp terminal through switch S51 during startup. When the ramp signal reaches and exceeds $2V_{bg}$, a current will be drawn through resistor R60 that is proportional to the difference between the ramp voltage and $2V_{bg}$, and the resulting current will be mirrored through resistor R50, producing a control voltage proportional to the ramp signal.

While the invention has been particularly shown and described with reference to the preferred embodiments thereof, It it will be understood by those skilled in the art that the foregoing and other changes in form, and details may be made therein without departing from the spirit and scope of the invention.

What is claimed is:

1. A power supply circuit for detachably coupling a hot-pluggable subsystem, wherein said power supply circuit comprises:

a power supply output for supplying power to a load;

a pass device coupled to said power supply output for controlling said supplied power; and a control circuit coupled to a continuously adjustable control terminal of said pass device, wherein said control circuit adjusts said control terminal of said pass device at a predetermined rate, detects a current through said pass device and adjusts said rate in conformity with said detected current.

2. The power supply circuit of claim 1, further comprising a sense resistor coupled to said control circuit and further coupled to said pass device for detecting said current.

3. The power supply circuit of claim 2, wherein said sense resistor is coupled to a feedback circuit within said control circuit, whereby said detected drain current reduces the rate of rise of said voltage at said control terminal of said pass device.

4. The power supply circuit of claim 2, wherein said control circuit comprises:

a ramp generator coupled to said control terminal of said pass device for controlling said current through said pass device; and a voltage controlled current source having an input coupled to said sense resistor for detecting said current through said pass device and having an output coupled to said ramp generator for reducing a rate of rise of said voltage at said control terminal of said pass device in conformity with said detected current.

5. The power supply circuit of claim 4, wherein said control circuit further comprises a transconductor having an input coupled to an output of said ramp generator and having an output coupled to said control terminal of said pass device.

6. The power supply circuit of claim 5, wherein said transconductor has a threshold bias voltage below which said transconductor produces a null output, whereby said control terminal of said pass device is not driven until a voltage of said ramp generator output reaches said threshold bias voltage.

7. The power supply circuit of claim 5, wherein said control circuit further comprises a switch for coupling said output of said transconductor to said control terminal of said pass device for disconnecting said output of said transconductor from said control terminal of said pass device after said output of said ramp generator has reached a predetermined voltage, and wherein said switch further couples said control terminal of said pass device to a fixed voltage source when said output of said transconductor is disconnected from said control terminal of said pass device.

8. The power supply circuit of claim 6, wherein said ramp generator comprises a current mirror having an input coupled to a bandgap reference for producing a charging current of said ramp generator.

9. The power supply circuit of claim 1, wherein said control circuit further comprises:

a capacitor for controlling at least one timing function within said control circuit and for preventing transient turn-on of said pass device due to an initial application of voltage across said pass device, wherein said capacitor is coupled to a timing circuit and further coupled to said control terminal of said pass device; and an isolation circuit for decoupling said control terminal of said pass device from said capacitor subsequent to said initial application of voltage across said pass device, such that said capacitor may be used for said timing functions without disrupting operation of said pass device.

10. The power supply circuit of claim 9, further comprising:

a sense resistor coupled to said control circuit and further coupled to said pass device for detecting said current through said pass device;

a ramp generator coupled to a control terminal of said pass device for controlling said current through said pass device; and a voltage controlled current source having an input coupled to said sense resistor for detecting said current through said pass device and having an output coupled to said ramp generator for reducing a rate of rise of a said voltage at said control terminal of said pass device in conformity with said detected current.

11. The power supply circuit of claim 1, wherein said control circuit comprises a depletion-mode transistor coupled between said control terminal of said pass device and further coupled to a negative power supply input of said power supply, and wherein a gate of said depletion-mode transistor is coupled to a reference voltage for turning off said depletion-mode transistor subsequent to an initial application of voltage across said pass device.

12. The power supply circuit of claim 1, wherein said control circuit comprises a switch for decoupling said control terminal of said pass device after a voltage of said control terminal has reached a full-on level, and wherein said switch further couples said control terminal of said pass device to a fixed voltage source when said control terminal is decoupled.

13. The power supply circuit of claim 1, wherein said control circuit comprises an auto-restart circuit that disables said control terminal of said pass device in response to detecting that a restart condition has occurred.

14. The power supply circuit of claim 13, wherein said control circuit further comprises a circuit breaker for activating in response to said detected current through said pass device exceeding a predetermined maximum value, and wherein said auto-restart circuit is activated in response to activation of said circuit breaker.

15. The power supply circuit of claim 13, wherein said control circuit further comprises a startup timer, and wherein said auto-restart circuit is activated in response to expiration of a timer period of said startup timer when said detected current through said pass device exceeds a predetermined value at said expiration of said timer period.

16. The power supply circuit of claim 15, wherein said control circuit further comprises a circuit breaker for activating in response to said detected current through said pass device exceeding a predetermined maximum value, and wherein said auto-restart circuit is further activated in response to activation of said circuit breaker.

17. A power supply circuit for detachably coupling a hot-pluggable subsystem, wherein said power supply circuit comprises:

a power supply output for supplying power to a load;

a pass device coupled to said power supply output for controlling said supplied power;

a control circuit coupled to a control terminal of said pass device, wherein said control circuit comprises:

a capacitor for controlling at least one control function within said control circuit and for preventing transient turn-on of said pass device due to an initial application of voltage across said pass device, wherein said capacitor is coupled to a circuit for performing said control function and further coupled to said control terminal of said pass device; and an isolation circuit for decoupling said control terminal of said pass device from said capacitor subsequent to said initial application of voltage across said pass device, such that said capacitor may be used for said control functions without disrupting operation of said pass device.

18. The power supply circuit of claim 17, wherein said isolation circuit is a diode coupled between said control terminal of said pass device and further coupled to said capacitor, and wherein said diode is reverse-biased subsequent to said initial application of voltage.

19. The power supply circuit of claim 17, wherein said control function controls the charging of said control terminal of said pass device.

20. The power supply circuit of claim 19, wherein said control circuit further comprises a switch for decoupling said capacitor from said circuit for performing said control function and for coupling said capacitor to a timing circuit for providing a timing function.

21. The power supply circuit of claim 20, wherein said timing circuit is a power-good timer for producing at least one power-good output.

22. The power supply circuit of claim 19, wherein said control circuit further comprises a ramp generator, and wherein said capacitor is further coupled to said ramp generator for providing one of said at least one timing function.

23. The power supply circuit of claim 19, wherein said control circuit further comprises a transconductor having an input coupled to said capacitor and an output coupled to said control terminal of said pass device for controlling current through said pass device in conformity with a voltage across said capacitor.

24. The power supply circuit of claim 17, wherein said control function is a timing function, and wherein said capacitor is coupled to a timing circuit.

25. The power supply circuit of claim 24, further comprising a plurality of external impedances coupled to said control circuit for determining a plurality of time constants, and wherein said control circuit comprises a selector for selecting among said plurality external impedances, so that a sequence of timing functions may be performed.

26. The power supply circuit of claim 25, wherein said impedances are resistors and wherein said selector couples said resistors to said capacitor for programming a plurality of time constants.

27. The power supply circuit of claim 25, wherein said timing functions sequence activation of a plurality of power-good signals.

28. A power supply circuit for detachably coupling a hot-pluggable subsystem, wherein said power supply circuit comprises:

a power supply output for supplying power to a load;

a pass device coupled to said power supply output for controlling said supplied power;

a control circuit coupled to a control terminal of said pass device, wherein said control circuit comprises:

a capacitor coupled to a charging circuit for controlling charging said control terminal of said pass device; and an isolation circuit for decoupling said capacitor from said charging circuit, such that said capacitor may be used for said timing functions without disrupting operation of said pass device.

29. The power supply circuit of claim 28, wherein said isolation circuit comprises a switch for decoupling said capacitor from said charging circuit and for coupling said capacitor to a timing circuit for providing a timing function.

30. The power supply circuit of claim 29, wherein said timing circuit is a power-good timer for producing at least one power-good output.

31. The power supply circuit of claim 29, further comprising a plurality of external impedances coupled to said control circuit for determining a plurality of time constants, and wherein said control circuit comprises a selector for selecting among said plurality external impedances, so that a sequence of timing functions may be performed.

32. The power supply circuit of claim 31, wherein said impedances are resistors and wherein said selector couples said resistors to said capacitor for programming a plurality of time constants.

33. The power supply circuit of claim 31, wherein said timing functions sequence activation of a plurality of power-good signals.

34. A power supply circuit for detachably coupling a hot-pluggable subsystem, wherein said power supply circuit comprises:

a power supply output for supplying power to a load;

a pass device coupled to said power supply output for controlling said supplied power; and a control circuit coupled to a control terminal of said pass device, wherein said control circuit comprises an auto-restart circuit that disables said control terminal of said pass device in response to detecting that a restart condition has occurred.

35. The power supply circuit of claim 34, wherein said control circuit further comprises a circuit breaker for activating in response to a detected current through said pass device exceeding a predetermined maximum value, and wherein said auto-restart circuit is activated in response to activation of said circuit breaker.

36. The power supply circuit of claim 34, wherein said control circuit further comprises a startup timer, and wherein said auto-restart circuit is activated in response to expiration of a timer period of said startup timer when a detected current through said pass device exceeds a predetermined value at said expiration of said timer period.

37. The power supply circuit of claim 36, wherein said control circuit further comprises a circuit breaker for activating in response to a detected current through said pass device exceeding a predetermined maximum value, and wherein said auto-restart circuit is further activated in response to activation of said circuit breaker.

38. A method for controlling a power supply current from a power supply output coupled to a hot-pluggable subsystem, wherein said power supply current is conducted through a pass device having a control terminal, said method comprising:

supplying a voltage to said control terminal to turn on said pass device;

detecting a detected current through said pass device; and subsequently controlling a rate of turn-on of said pass device by controlling said control terminal in conformity with said detected drain current.

39. The method of claim 38, wherein said controlling is performed by subtracting a current corresponding to said drain current from a reference current to produce a control terminal current control that reduces a rate of rise of said control terminal current in conformity with said detected drain current.

40. The method of claim 38, further comprising:

determining whether or not a restart condition has occurred; and in response to determining that said restart condition has occurred, discharging said control terminal of said pass device.

41. The method of claim 40, further comprising:

determining whether or not that said drain current has exceeded a predetermined maximum level; and in response to determining that said drain current has exceeded said predetermined maximum level, setting said auto-restart condition.

42. The method of claim 41, further comprising:

determining whether or not that said drain current has exceeded a predetermined short-circuit level for a predetermined time period; and in response to determining that said drain current has exceeded said predetermined short-circuit level, setting said auto-restart condition.

43. The method of claim 40, further comprising:

determining whether or not that said drain current has exceeded a predetermined short-circuit level for a predetermined time period; and in response to determining that said drain current has exceeded said predetermined short-circuit level, setting said auto-restart condition.

44. A method for controlling a power supply current from a power supply output coupled to a hot-pluggable subsystem, wherein said power supply current is conducted through a pass device having a control terminal coupled to a capacitor, said method comprising:

applying a voltage across said pass device;

shunting transient current conducted through a parasitic capacitance of said pass device into said capacitor;

isolating said capacitor from said control terminal of said pass device subsequent to said shunting; and charging said capacitor subsequent to said isolating to provide a control function.

45. The method of claim 44, further comprising controlling said control terminal of said pass device to provide a controlled turn-on of said pass device in response to said charging.

46. The method of claim 45, further comprising detecting a detected current through said pass device and wherein said controlling is further performing in response to said detecting.

47. The method of claim 44, wherein said control function is a timing function.

48. The method of claim 47, further comprising:

detecting a voltage across said capacitor in response to said charging; and determining whether or not a time period has elapsed in response to said detecting.

49. The method of claim 48, further comprising:

selecting among a plurality of impedances to supply current for said charging; and in response to determining said time period has elapsed, selecting another one of said plurality of impedances.

* * * * *